US005228595A

United States Patent [19]

Booker

[11] Patent Number: 5,228,595

[45] Date of Patent: Jul. 20, 1993

[54] ORAL HYGIENE DEVICE

[76] Inventor: Winifred Booker, 2548 McCulloh St., Baltimore, Md. 21217

[21] Appl. No.: 804,553

[22] Filed: Dec. 10, 1991

Related U.S. Application Data

[63] Continuation-in-part of Ser. No. 511,298, Apr. 19, 1990, abandoned.

[51] Int. Cl.[5] ..... B67D 5/00

[52] U.S. Cl. ..... 222/78; 222/129; 222/179.5; 222/192

[58] Field of Search ..... 222/78, 93, 106, 129, 222/132, 179.5, 192; 239/211; 132/308, 309, 310

[56] References Cited

U.S. PATENT DOCUMENTS

| | | | |
|---|---|---|---|
| 1,050,560 | 1/1913 | Moore | 222/192 |
| 1,858,134 | 5/1932 | Booth et al. | 222/93 |
| 2,609,122 | 9/1952 | Stenerson | 222/93 |
| 2,771,219 | 11/1956 | Dewey | 222/78 |
| 3,105,612 | 10/1963 | Krasnoff et al. | 222/78 |
| 3,178,060 | 4/1965 | Bossack | 222/78 |
| 3,275,195 | 9/1966 | Reinstra | 222/78 |
| 3,987,932 | 10/1976 | Maldon | 222/93 X |
| 4,010,870 | 3/1977 | Wilson | 222/78 |
| 4,121,600 | 10/1978 | Riddick et al. | 132/310 |
| 4,796,783 | 1/1989 | Paulson | 222/93 X |
| 4,827,951 | 5/1989 | Grussmark | 222/192 X |
| 4,836,415 | 6/1989 | Grussmark | 222/192 X |
| 4,991,755 | 2/1991 | Grussmark | 222/192 X |

FOREIGN PATENT DOCUMENTS

| | | | |
|---|---|---|---|
| 250134 | 4/1926 | United Kingdom | 239/211 |

*Primary Examiner*—Andres Kashnikow
*Assistant Examiner*—A. Pomrening
*Attorney, Agent, or Firm*—Kenyon & Kenyon

[57] ABSTRACT

A device for holding and dispensing oral hygiene products directed toward children is provided. The device consists of a child-friendly figure which is capable of holding and dispensing mouthwash. Appendages of the figure, e.g., arms or legs of an animal, are adapted to hold a toothbrush and a removable container shaped to resemble an item associated with the figure. The removable container, which itself is comprised of top and bottom portions, is adapted to hold a tube of toothpaste therein. Additionally, one portion of the removable container can be adapted to hold and dispense dental floss and to be used as a cup.

9 Claims, 5 Drawing Sheets

ORAL HYGIENE DEVICE

This application is a Continuation-in-Part of Ser. No. 07/511,298, filed Apr. 19, 1990, now abandoned.

FIELD OF THE INVENTION

The present invention generally relates to holding and dispensing oral hygiene products. More particularly, the invention relates to a device directed to children for holding and dispensing oral products such as a toothbrush, toothpaste, mouthwash, and dental floss and to a method of promoting proper oral hygiene in children incorporating the aforementioned device, which preferably is in the form of an animal, cartoon or action figure.

BACKGROUND OF THE INVENTION

It is well recognized that the earlier a person begins a proper oral hygiene regimen, the more likely he or she will not experience tooth decay and other serious oral hygiene related health problems in his/her adolescence and adult years. It is similarly known that children rarely follow an oral hygiene regimen without constant adult supervision and cajoling. The reasons for children's lack of enthusiasm to follow an oral hygiene regimen are many.

Some children find oral hygiene regimens to be unpleasant, since it is rarely accompanied by anything a child perceives as fun. However, since children of all ages are fascinated by animals, cartoons and/or action figures, oral hygiene regimens which could include such toys or figures stand a better chance of being followed. Other children, particularly younger ones must be supervised during oral hygiene regimens. However, younger children like to seem grown-up by doing things for themselves, so an easy-to-operate device in the shape of an animal, cartoon, or action figure which allows children to dispense oral hygiene products themselves, should encourage and motivate children to engage in and follow a regimen of proper dental care. In particular, children enjoy operating devices which dispense "hidden" contents.

Older children, even if they are inclined to follow an appropriate regimen, can be overwhelmed by the necessity to gather up all of the items necessary for proper oral health—they have to find their toothpaste, then their toothbrush, the mouthwash, a cup and then the floss. In most households, that involves opening cabinets, to gather everything and then putting it all back when they are through—a lot for a young child to do. Moreover, it is difficult to keep the child brushing and/or flossing and/or rinsing for an appropriate amount of time, which is presently determined to be 3½ minutes.

Many devices have been proposed to assist in getting children to follow an appropriate regimen. For example, there are devices in the shape of animals or cartoon or action figures. These devices, which children may relate to fun, may invite a child to practice oral hygiene. However, most of these devices do not provide for a complete oral hygiene regimen. For example, U.S. Pat. No. 3,105,612 to Krasnoff et al., discloses an animated toy toothpaste container adapted to hold a toothbrush. To dispense toothpaste, the figure must be held, tilted and squeezed. Similarly, U.S. Pat. No. 4,010,870 to Wilson, provides for a toy figure which dispenses toothpaste and holds a toothbrush. To dispense toothpaste from this device, one arm of the figure must be pressed downward.

The shortcomings of both of these devices are numerous. To use either, a young child has to hold or at least press upon the device itself, which will inevitably lead to dropped toys or broken arm mechanisms. Similarly, neither device provides for the easy rinsing of the mouth or flossing, which are a necessary part of any successful oral hygiene regimen. Since both devices provide for the storing of toothpaste within the interior body of the figures, they would be difficult to adapt to dispense all of the necessary oral hygiene products.

A few all-in-one type oral hygiene dispensing devices have been disclosed. For example, U.S. Pat. No. 4,121,600 to Riddick et al. discloses a wall or counter mounted device in which the toothpaste and toothbrush are held inside of a housing. The dispensing device of Riddick also provides for the dispensing of mouthwash and cups, but does not provide for the dispensing of dental floss. While the Riddick et al. dispensing device allows for most of the needed oral hygiene products to be in one place, it is not child-friendly. For example, the toothpaste and toothbrushes are not in view and could be forgotten. Moreover, it is somewhat awkward for a child to go into a closed cabinet. Additionally, it is bulky in shape and would not naturally encourage a child to complete his/her oral hygiene regimen.

Importantly, none of the oral hygiene dispensing devices provides for any mechanism to keep the child brushing and/or flossing and/or rinsing for an appropriate amount of time, which is presently determined to be 3 minutes.

Accordingly, it is an object of the present invention to provide a device which conveniently holds several oral hygiene products and which provides for the easy dispensing of such products.

It is a further object of this invention to provide for a device for holding and dispensing oral hygiene products which is directed to children.

Yet another object of this invention is to provide for a device for holding and dispensing oral hygiene products which can be integrated into a method of oral hygiene directed towards children.

The above objects of the present invention will be more fully understood, and further objects and advantages will become apparent, from the following description of the invention.

SUMMARY OF THE INVENTION

The present invention provides an apparatus and a method for holding and dispensing oral hygiene products in a manner that encourages children to follow an effective oral hygiene regimen. The present invention comprises an animal, cartoon or action figure and provides for a toothbrush holder, a toothpaste dispenser and dental floss dispenser. The present invention further provides for holding and dispensing mouthwash and a timing device to encourage one to follow the oral hygiene regimen for an effective amount of time.

BRIEF DESCRIPTION OF THE DRAWINGS

FIG. 3(*b*) is an expanded view of the toothpaste dispensing end of the multipurpose device shown in 3(*a*).

FIG. 4(*b*) is an expanded view of the dental floss dispenser and how it is integrated into the multipurpose device.

DETAILED DESCRIPTION OF THE INVENTION

Figure 1:
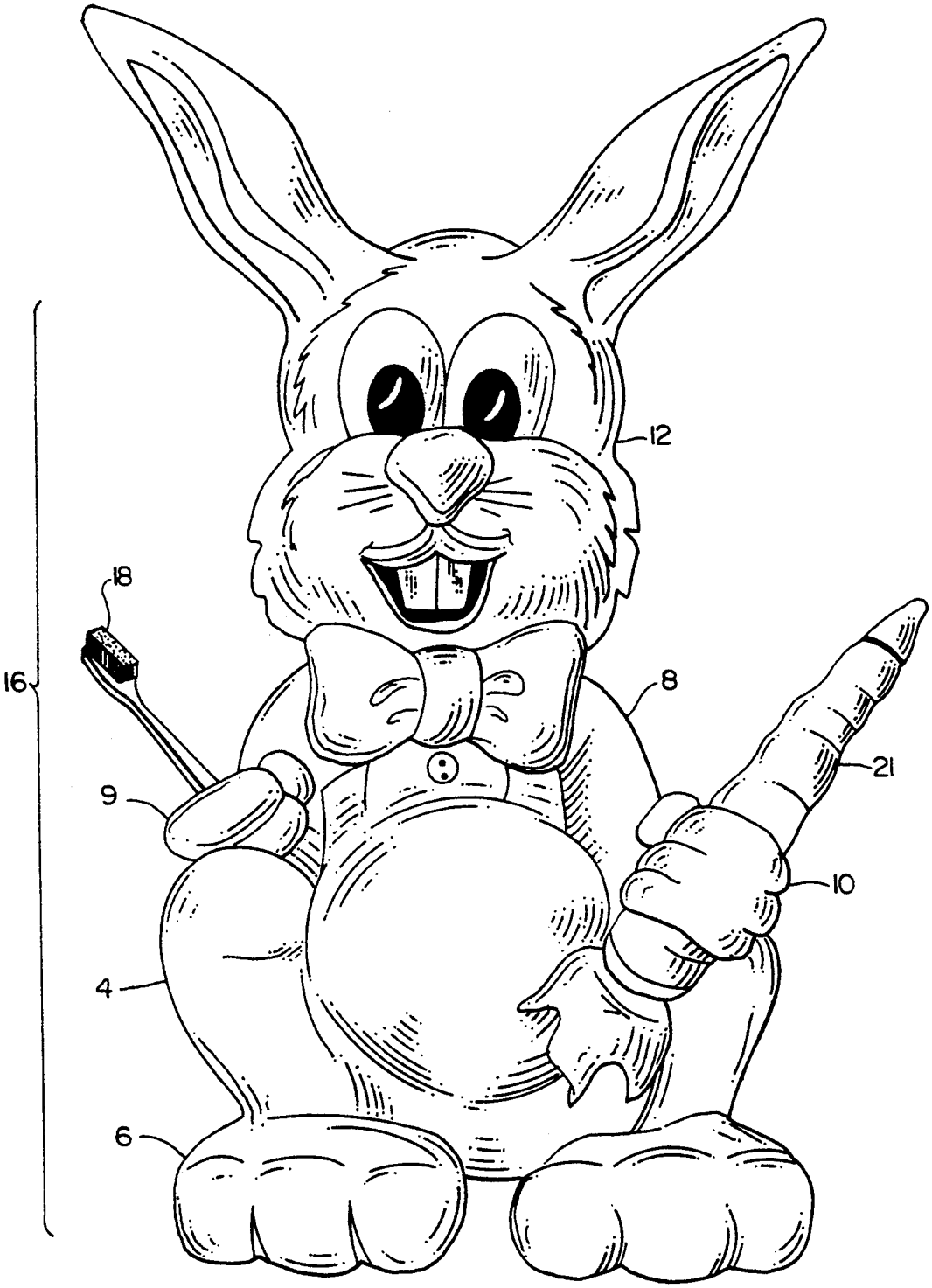
FIG. 1 is a front elevation view of an apparatus for holding and dispensing oral hygiene products in accordance with an embodiment of the present invention.

The present invention can be described in detail by referring to a particular embodiment illustrated in the figures, which depict the oral hygiene product holding and dispensing apparatus in the shape of a rabbit. As depicted in FIG. 1, the apparatus comprises a figure on a stable base, wherein one appendage is adapted to hold toothbrushes and a second appendage is adapted to hold a device comprising a toothpaste dispenser and a dental floss dispenser. As further depicted in FIG. 2, the body of the figure is hollow and adapted to hold and dispense mouthwash.

In the embodiment of the invention depicted in the drawings, the stable base comprises two feet 6 which are connected to the body 16 by legs 4. However, the present invention includes alternative ways of forming a stable base. For example, when the figure is a rabbit, the stable base can be provided by feet and an optional tail in combination, wherein the legs are bent, placing the rabbit in a crouched position. In the embodiment of the invention depicted, the two appendages are paws 9 and 10, which are connected to the body by arms 8. The paws 9 and 10 are provided with apertures, with one paw 9 being adapted to hold one or more toothbrushes 18, while paw 10 is adapted to hold a multipurpose device 21, which is comprised of a toothpaste dispenser, a dental floss dispenser and a cup. In the illustrated embodiment, the toothbrush 18 and the multipurpose device 21 are slightly extended toward the user by means of the partially bent arms 8. The apparatus is further provided with a head 12 connected to the body. Preferably head 12 is provided with a face with a pleasant or happy expression, and showing healthy teeth and gums.

Figure 2:
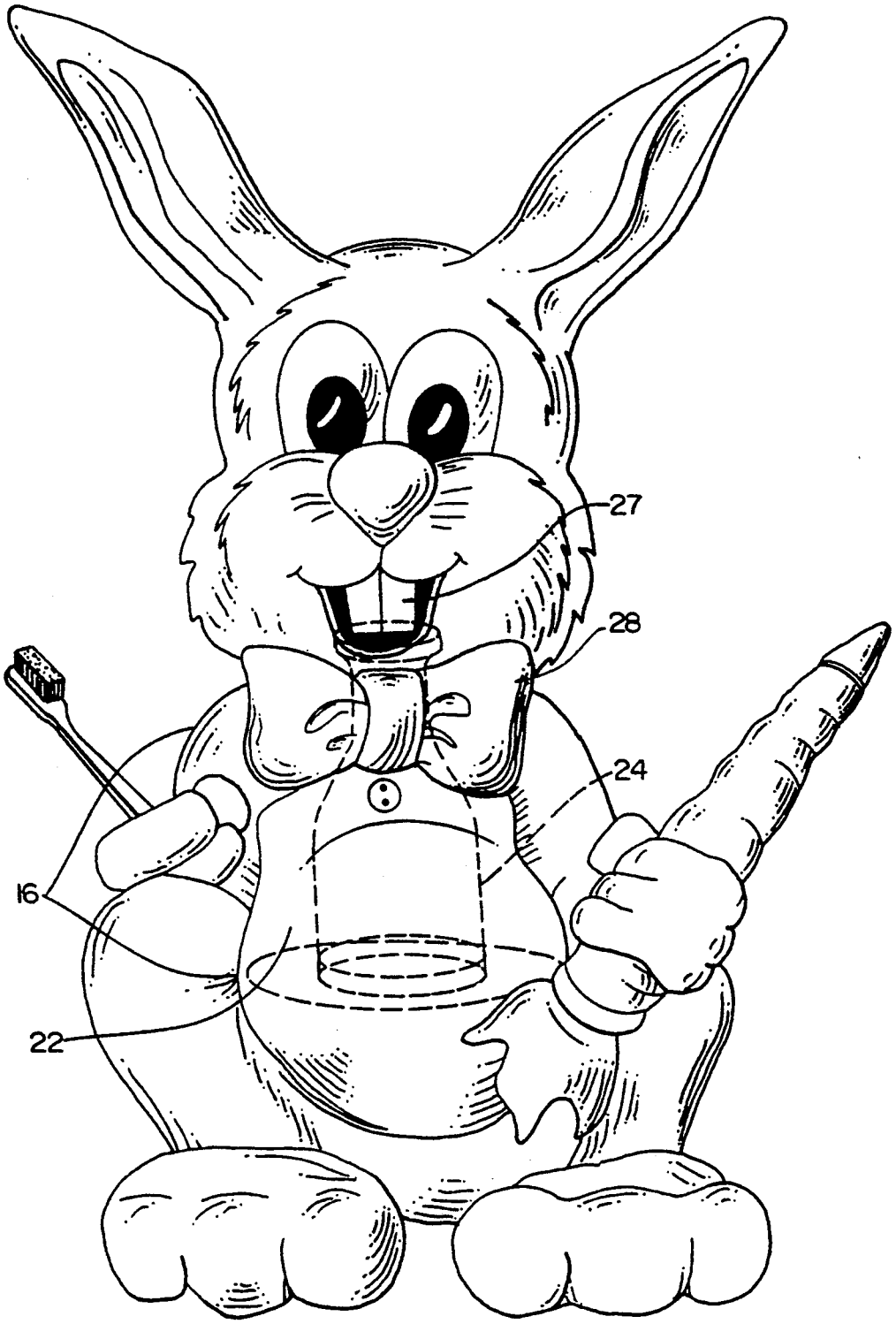
FIG. 2 is a front elevational view, partly in section, of the embodiment shown in FIG. 1.

As shown in FIG. 2, the hollow body 16 has a therein a chamber 24 having a flat bottom. Access to the chamber is through the hinged panel 22 which is opened by depressing the lever means 28, which in FIG. 2 is depicted as the rabbit's bow tie. The chamber 24 is sufficiently large to hold a container of mouthwash, which can be replaced periodically.

Figure 2A:
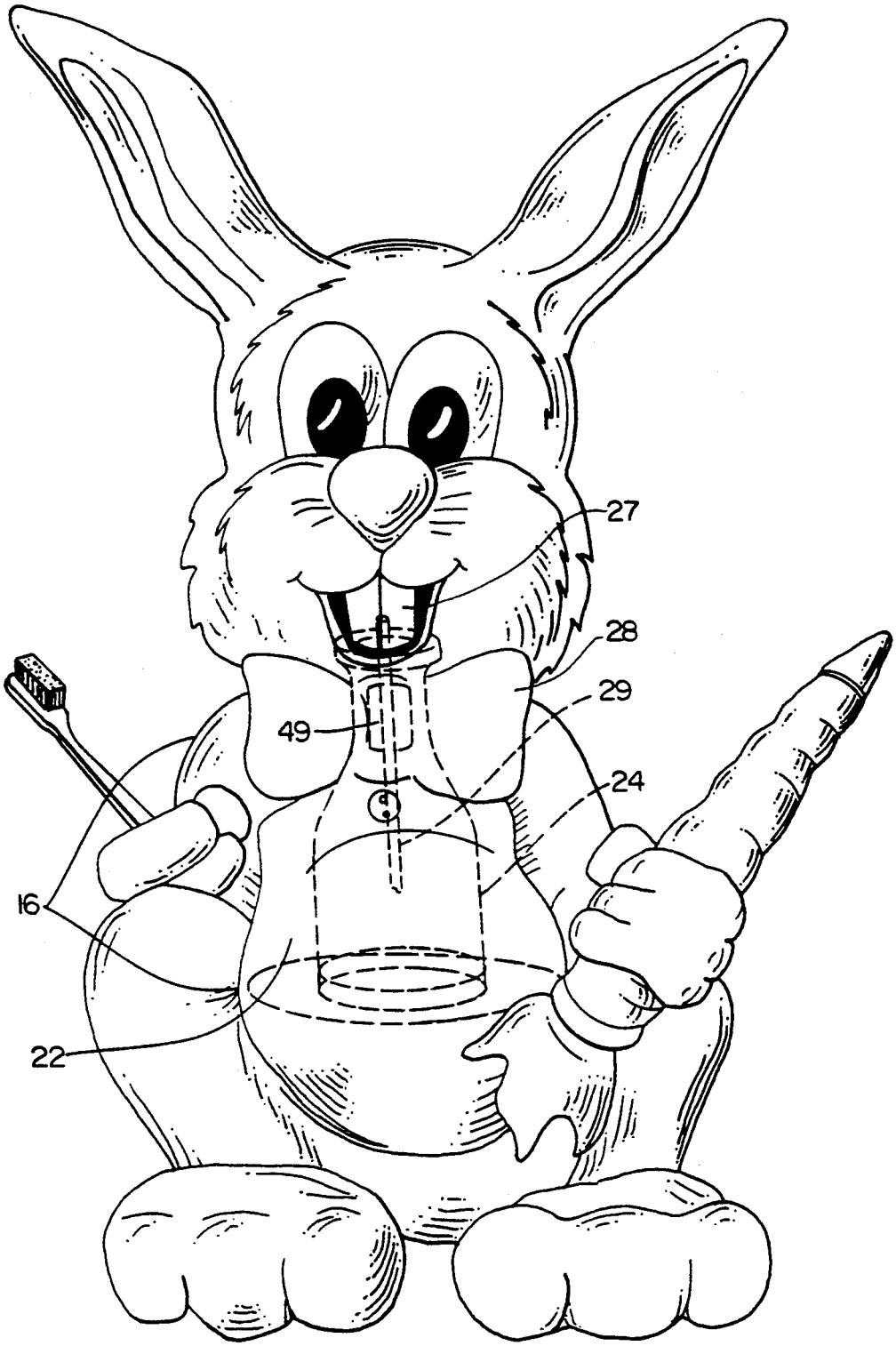
FIG. 2*a* is a front elevational view, partly in section, of an alternate embodiment of the present invention.

In the preferred embodiment, the mouthwash is dispensed by removing an unbreakable container of mouthwash from chamber 24 and pouring a premeasured amount of mouthwash into a cup. Alternatively, a pumping means can be provided so mouthwash can be dispensed without removing a bottle or a container from the chamber. In such an alternative embodiment as shown in FIG. 2*a*, the outlet valve of the pumping mechanism, which in the rabbit configuration would be the incisors 27, is connected to a dip tube 29 and pump chamber 49. Upon actuation, a cup is placed so as to collect the predetermined amount of mouthwash which is released from a tube located just behind the second lever means. Or, in a less preferred embodiment, the predetermined amount of mouthwash may collected in a collecting means which in the rabbit of FIG. 1 will be the floor of the rabbit's mouth. The entire apparatus is then tilted forward to pour the mouthwash into a cup.

Figures 3A, 3B, 4A, 4B:
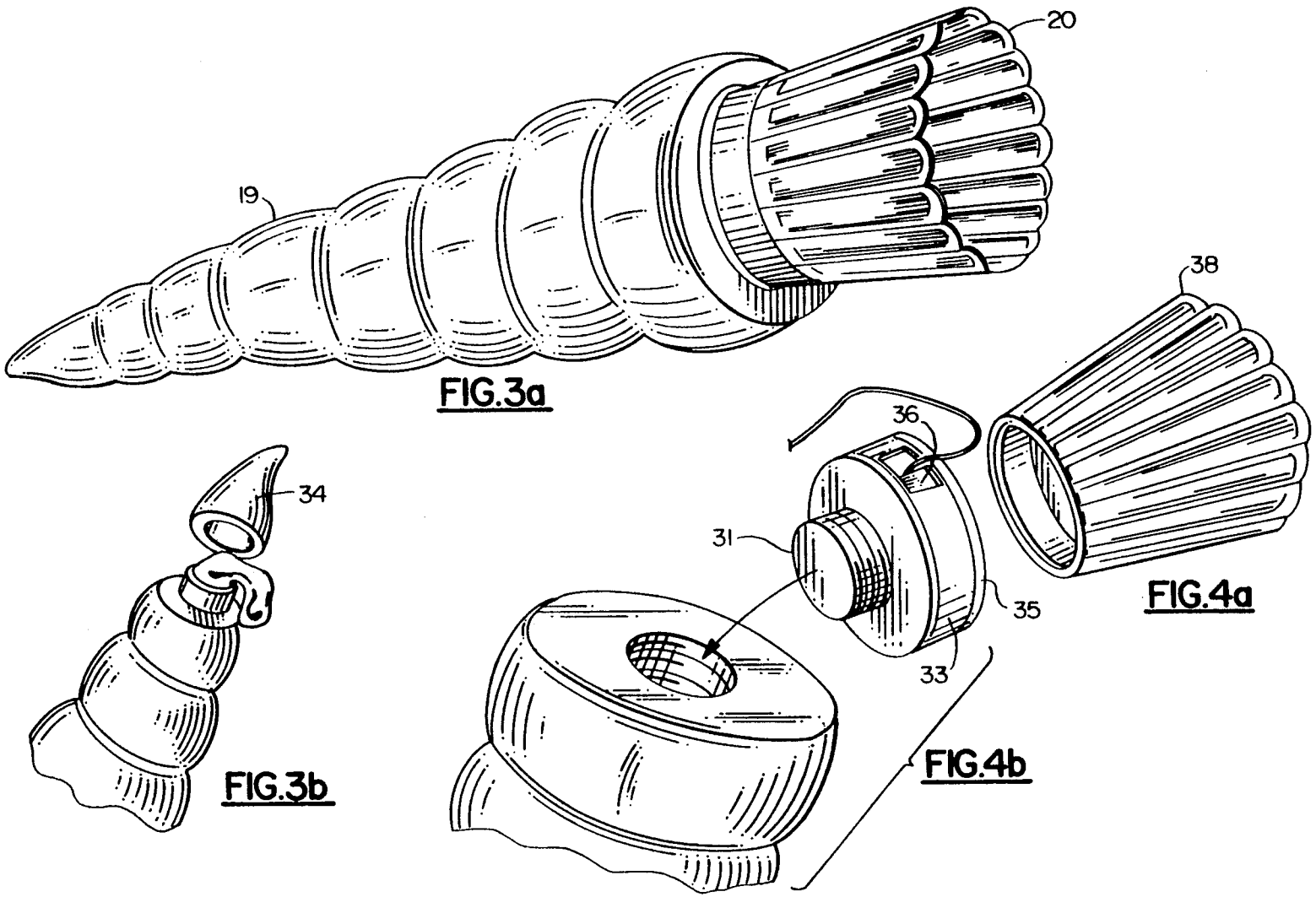
FIG. 3(*a*) is a view of a multipurpose device comprising a toothpaste dispenser, a dental floss dispenser and a cup.
FIG. 4(*a*) is a view of the cap portion of the multipurpose device.

The multipurpose device 21 is shown in more detail in FIGS. 3 and 4. In the preferred embodiment, as illustrated, the multipurpose device is depicted as a carrot which is particularly advantageous since it helps to remind children that vegetables are important for strong teeth and good health. In the illustrated embodiment, the multipurpose device 21 can be readily disassembled into a toothpaste dispenser 19, a top 20 and a cup 38. The toothpaste dispenser 19 has a flexible, wedge-shaped tubular body, shaped to accept a flexible tube of toothpaste which can be insert through the wide end of the tubular body. Alternatively, toothpaste can be squeezed into the tubular body through the wide end of the tubular body. The toothpaste dispenser further consists of a cap 34, which either screws on or can be flipped open, at its narrow end from which toothpaste can be dispensed onto a toothbrush.

The wide end of toothpaste dispenser 19 is closed by top which functions as dental floss dispenser 33. While one end 31 of the top is adapted to close the wide end of the toothpaste dispenser, either by screwing into the aperture or by way of a slight force fit, the broad end 35 of the top is adapted to hold and dispense dental floss. The dental floss dispenser is further adapted to accept a dental floss severing device 36. The cup 38, which fits over the dental floss dispenser, is provided. Preferably, the diameter of the cup is slightly less than that of the dental floss dispenser so as to create a force fit. In an alternative embodiment particularly directed to younger children, the dental floss dispenser and the cup are one integral unit. In such an embodiment the dental floss is dispensed from the flat (underneath) surface of the dental floss dispenser.

Figure 5:
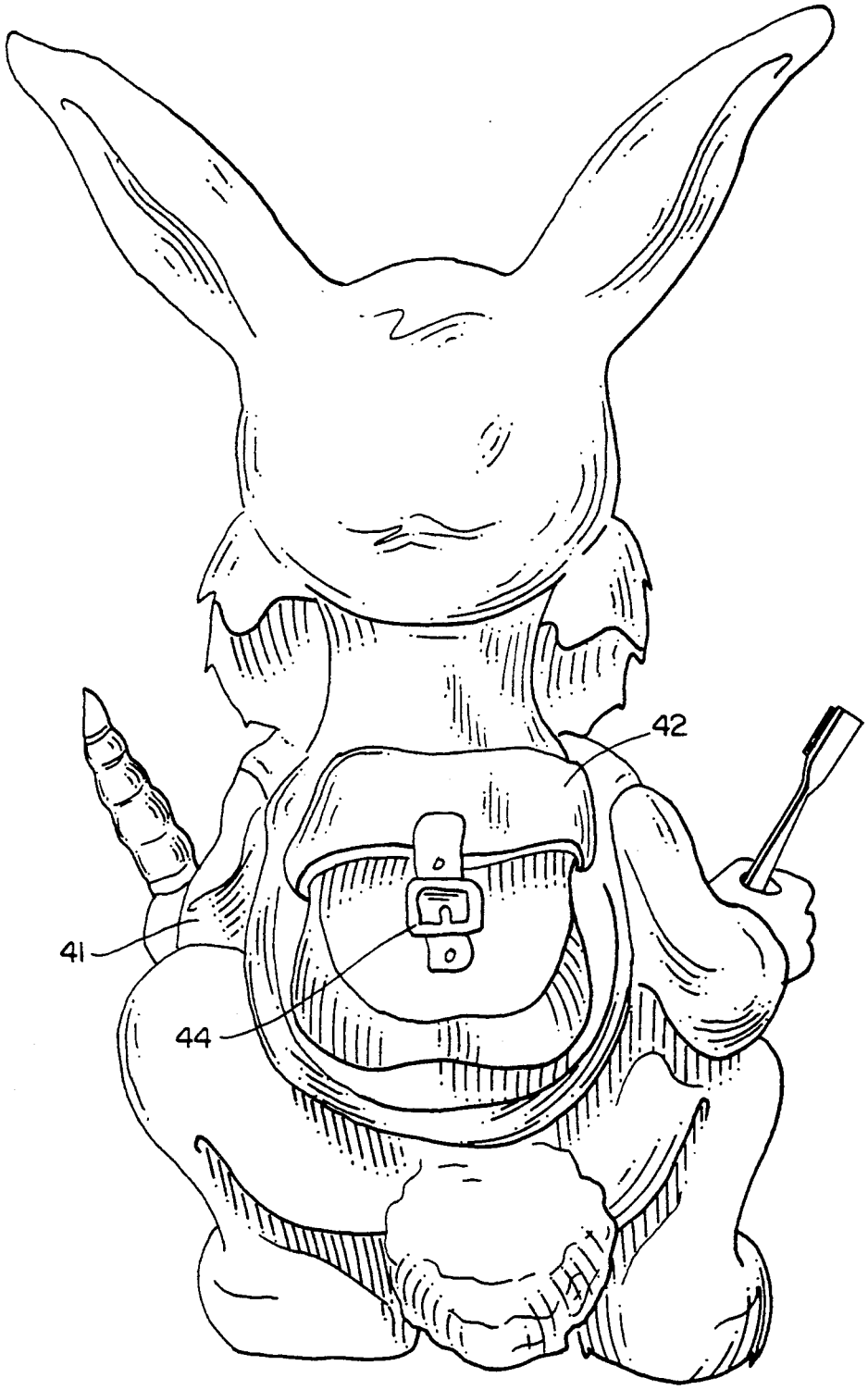
FIG. 5 is a view of a timing device in accordance with an embodiment of the present invention.

The apparatus can further be provided with a timing device 41 which will encourage the child to maintain the oral hygiene regiment for an appropriate amount of time. In order to keep the child's attention, in the preferred embodiment, as shown in FIG. 5, the timing device consists of a spring 44 actuated music box 42 which repeats an easy to remember children's song stressing proper oral hygiene. In preferred embodiments, the children's song will be approximately three minutes in length and repeated four times so as to insure a thorough oral hygiene regimen.

The oral hygiene apparatus of the present invention can, with little parental help or supervision, be used by children as part of an effective oral hygiene program. A child first activates the timing device. Then the child removes the multipurpose device from paw 9 and separates the toothpaste dispenser from the dental floss/dispenser cup assembly. Next, the child removes the toothbrush from paw 9. After opening the cap 34, the child squeezes the toothpaste dispenser 19 to dispense a desired amount of toothpaste onto the toothbrush 18. The child then closes the cap. After timing the toothpaste phase of the regime, the child can return the toothbrush to its aperture. The child then dispenses dental floss from the dental floss dispenser by grasping the floss, pulling away the desired amount, and severing the floss by wedging it in the dental floss severing device in the conventional manner. After brushing and flossing, the child can dispense mouthwash by depressing the lever means, which causes the hinged panel to open, taking out the mouthwash container and pouring the desired amount of mouthwash into a cup. Or, alternatively, by compressing a pumping mechanism if one is provided, mouthwash will flow from the mouthwash container into an appropriately placed cup. When the child has completed brushing, flossing and rinsing, the mouthwash container is placed back into the chamber, the hinged panel is closed and the multipurpose device can be reassembled and replaced in its aperture.

All of the steps of the oral hygiene regimen can be easily performed by an older toddler. Another advantageous attribute of the present invention is that it helps to improve the manual dexterity and hand-to-eye coordination of younger children. Further, the young child gets the satisfaction of having "done it myself."

The oral hygiene product dispenser can also be easily transformed into another teaching device for children—a bank. A slot can be provided in the neck of the apparatus to receive coins and folded bills. A container such as a dish can replace the mouthwash container in chamber 24 and be used to collect and store the savings. A small scroll, to keep track of the savings, can be placed in the cavity of the toothpaste dispenser and a pencil to record the savings on the scroll can be placed in the aperture which formerly held the toothbrush. In this way even after the child has incorporated the oral hygiene regimen into his/her daily routine, the present invention can be used to teach and promote an important custom to children.

It is clear that a number of variations of the foregoing device may be suggested to one of ordinary skill in this art upon reading the present specification. For example, although a rabbit holding a carrot is detailed in this specification, other figures holding things, e.g., a knight holding a sword or shield, or "Charlie Brown" ® holding a baseball bat, readily come to mind. Consequently, the embodiment described in this specification is illustrative only and is not intended to limit the scope of the present invention, which is defined by the following claims.

I claim:

1. A transportable, counter mountable device for holding and dispensing oral hygiene products and adapted for use by a young child, which comprises:

a stable base, a main body on said stable base wherein said main body has a hollow middle portion forming a compartment for storing mouthwash, a first appendage attached to a first side of the main body for holding at least one toothbrush, and a second appendage attached to a second side of the main body for holding a removably mountable multipurpose device, said multipurpose device comprising a toothpaste dispenser having a small end adapted to dispense toothpaste and a large end adapted to receive toothpaste for dispensing, a top removably mounted to the large end of the toothpaste dispenser and a cup which is removably mounted from the top.

2. The device of claim 1, wherein said main body further comprises a means for dispensing mouthwash from the compartment.

3. The device of claim 2 wherein the dispensing means includes a pumping means operable from the exterior of said main body.

4. The device of claim 1, wherein said main body further comprises a timing device which indicates to the user of the device the time required to perform an effective oral hygiene regimen.

5. The device of claim 4, wherein the timing device is mounted on to said main body.

6. The device of claim 1, wherein said top comprises a dental floss dispenser.

7. The device of claim 1, wherein the design and shape of said main body is selected from the group consisting of action figures, animals, historical figures and cartoon characters.

8. The device of claim 7, wherein said main body is a rabbit, said multipurpose device is a carrot and said appendages comprise paws connected to arms.

9. The device of claim 8, wherein a timing device in the shape of a knapsack is affixed to the back of said rabbit.

* * * * *